US007475862B1

(12) United States Patent
Anspach

(10) Patent No.: US 7,475,862 B1
(45) Date of Patent: Jan. 13, 2009

(54) STUB STEEL HOLDER

(76) Inventor: Gary D. Anspach, 20811 92nd Ave., Graham, WA (US) 98338

( * ) Notice: Subject to any disclaimer, the term of this patent is extended or adjusted under 35 U.S.C. 154(b) by 363 days.

(21) Appl. No.: 11/337,409

(22) Filed: Jan. 23, 2006

(51) Int. Cl.
*E04G 17/12* (2006.01)

(52) U.S. Cl. ..... 249/34; 249/93; 249/218; 52/699

(58) Field of Classification Search ..... 52/295, 52/365, 633, 678, 677, 684, 296, 686–689, 52/701; 248/65, 67, 67.5, 72, 74.1; 249/205, 249/207, 34, 91, 93, 216, 218; 43/21.2; 264/35
See application file for complete search history.

(56) References Cited

U.S. PATENT DOCUMENTS 2,704,412 A * 3/1955 Davis ..... 43/21.2
3,367,084 A * 2/1968 Reiland ..... 52/649.7
3,662,985 A * 5/1972 Parker ..... 249/219.1
3,722,842 A * 3/1973 Schweizer ..... 248/124.2
3,778,020 A * 12/1973 Burrows et al. ..... 249/219.1
4,029,288 A * 6/1977 Murphy et al. ..... 249/216
4,835,933 A 6/1989 Yung
5,688,428 A 11/1997 Maguire
5,937,604 A 8/1999 Bowron
5,984,243 A * 11/1999 Pfaller et al. ..... 248/74.1
D422,894 S 4/2000 Kubica
6,418,695 B1 7/2002 Daudet et al.
6,591,574 B2 * 7/2003 Humphrey ..... 52/678
6,672,029 B2 * 1/2004 Tucker ..... 52/745.21
6,719,486 B2 * 4/2004 Craghan ..... 404/119
2003/0070388 A1 4/2003 Catani et al.
2004/0216416 A1 * 11/2004 Hohmann et al. ..... 52/513

* cited by examiner

*Primary Examiner*—Robert J Canfield
*Assistant Examiner*—Christine T Cajilig
(74) *Attorney, Agent, or Firm*—Lawrence J. Gibney, Jr.

(57) ABSTRACT

This is a device, which is a construction tool, to ensure that the reinforced steel or rebar is installed appropriately in a footer. It can be installed over the footer casing and secures the rebar in the footer in the appropriate vertical position.

3 Claims, 4 Drawing Sheets

STUB STEEL HOLDER

BACKGROUND OF THE INVENTION

A. Field of the Invention

This is related to ensuring that steel, which is embedded in footers in buildings, is installed properly. This is necessary in order to maintain a level building and to give the walls of the building the maximum amount of strength and support.

B. Prior Art

There are many other prior art references in the construction trade relating to ensuring that the foundation of a building is level and well supported. An example of this type of device can be found in Daudet, U.S. Pat. No. 6,418,695, which is a building component's spacer brace. The Daudet application, however, does not specifically relate to ensuring that the steel reinforcements for a footer are installed in a vertical position correctly.

Another example in the prior art can be found at Maguire, U.S. Pat. No. 5,688,428. The device is Maguire is a holder for a vertically positioned piece of steel rebar. It does not, however, specifically relate to footers nor does it accomplish the objective in the same manner as the present application.

BRIEF SUMMARY OF THE INVENTION

In order to ensure that the building foundation and walls of the building are level and well supported, it is important to have the reinforced steel, which is commonly found in a structure, to be in the appropriate vertical position. This reinforced steel is often referred to as "rebar".

This device will be placed over the concrete footer mold and has a long flat horizontal bracket with pieces of stock or pieces of angle on either side. The angles that are on the sides will be secured to the appropriate securing structure for the building footer. Mounting holes are provided on the sides of the angles for that purpose.

Along the edge of the long flat bracket is a vertical member, which is secured to the long flat bracket or horizontal member. On the vertical member in the approximate center of the vertical member will be a support pipe, which is semicircular. The vertical rebar is placed in the support pipe, and a slide or collar slides over the rebar to secure it to this device. The piece of vertical rebar is secured to other pieces of rebar which have been placed on the ground and form the foundation of the building. The concrete is then poured into the footer casing or mold, and the concrete is allowed to set or cure. Once the concrete has set, the device is simply taken from the footer casing and installed on the next application.

It is an object of this device to ensure that the reinforced steel, or rebar, is installed in the building footer in the appropriate vertical position in a building to ensure the appropriate strength in the building structure.

DETAILED DESCRIPTION OF THE EMBODIMENTS

Figure 1:
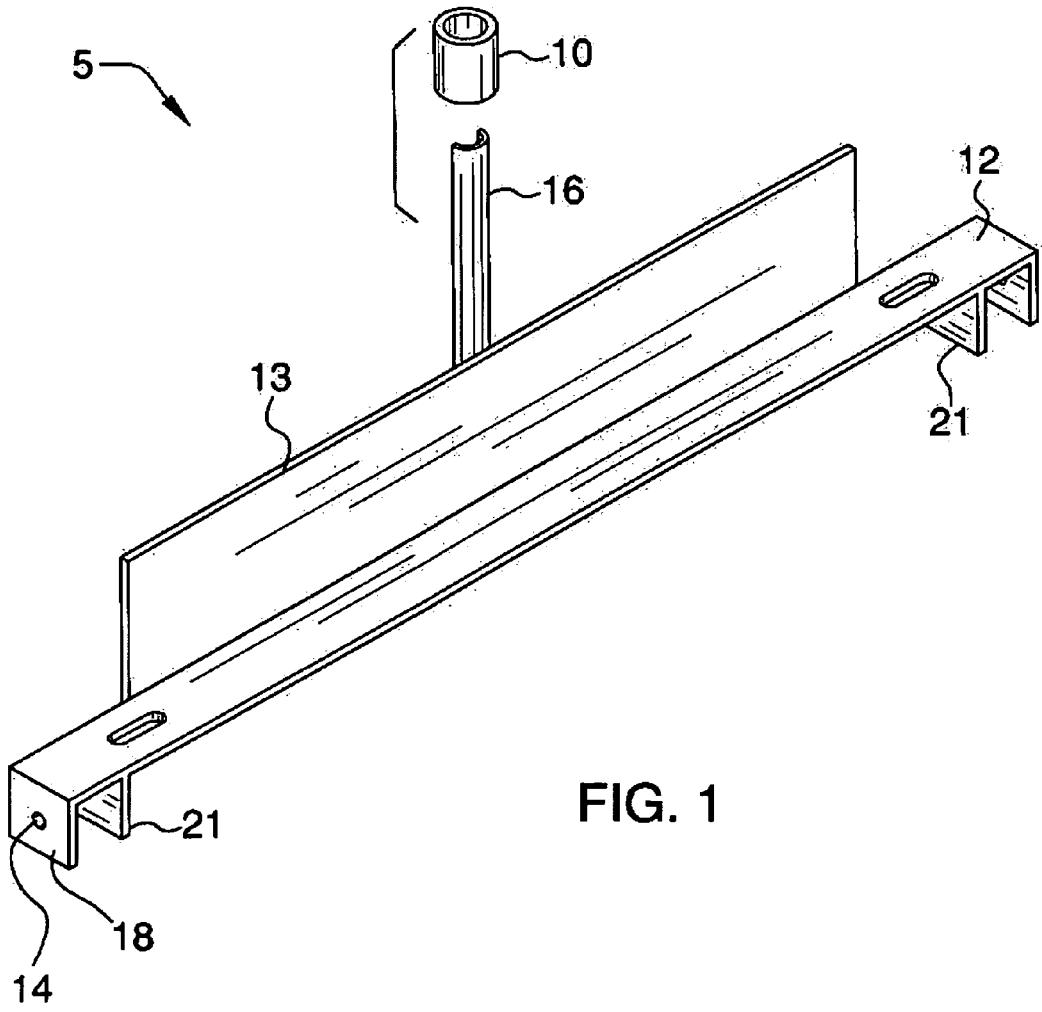
FIG. 1 is an isometric view of the device.
Figure 2:
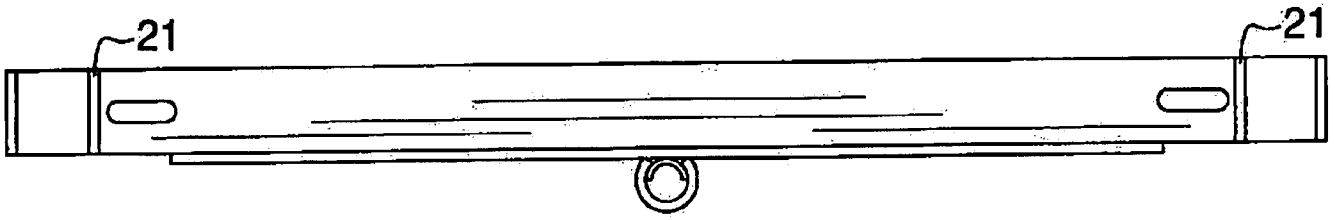
FIG. 2 is a bottom view of the device.
Figure 3:
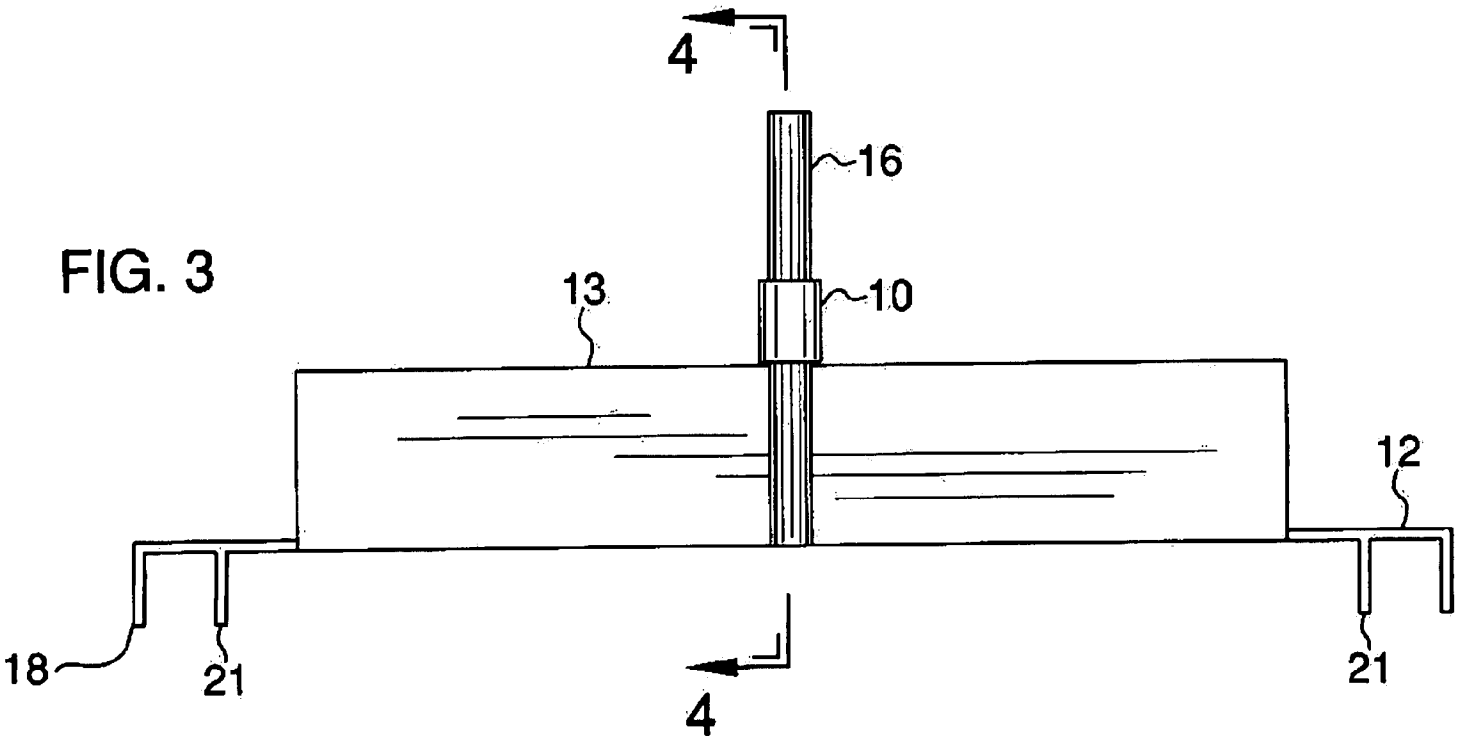
FIG. 3 is a back view of the device.
Figure 4:
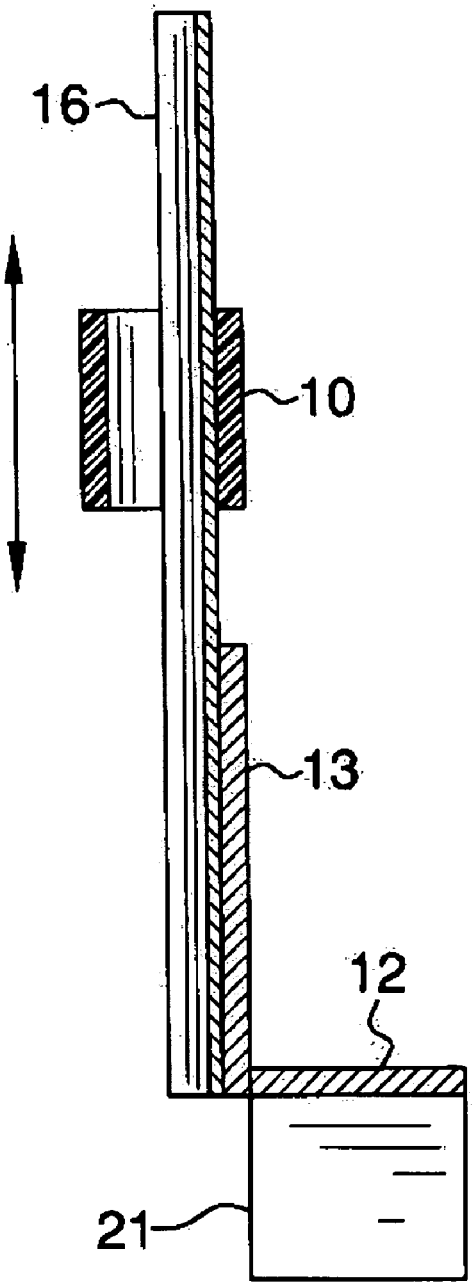
FIG. 4 is a view according to line 4-4 on FIG. 3.

Footers are located around the perimeter of a building to provide support for the foundation of the building and the walls of the building. In order to ensure that the footer is able to support the walls properly, pieces of reinforced steel 15 or "rebar" are placed in the footer, in a vertical position. This device 5 is a tool to ensure that the vertical rebar 15, or reinforced steel, is installed in the proper vertical position in the footer casing 20. A portion of the vertical rebar is above the level of the concrete once it is poured and a portion 24 is below the level of the concrete. Prior to pouring the concrete 25 for the footer a casing or mold 20 is constructed into which the concrete 25 is poured to form the footer 20.

Figure 5:
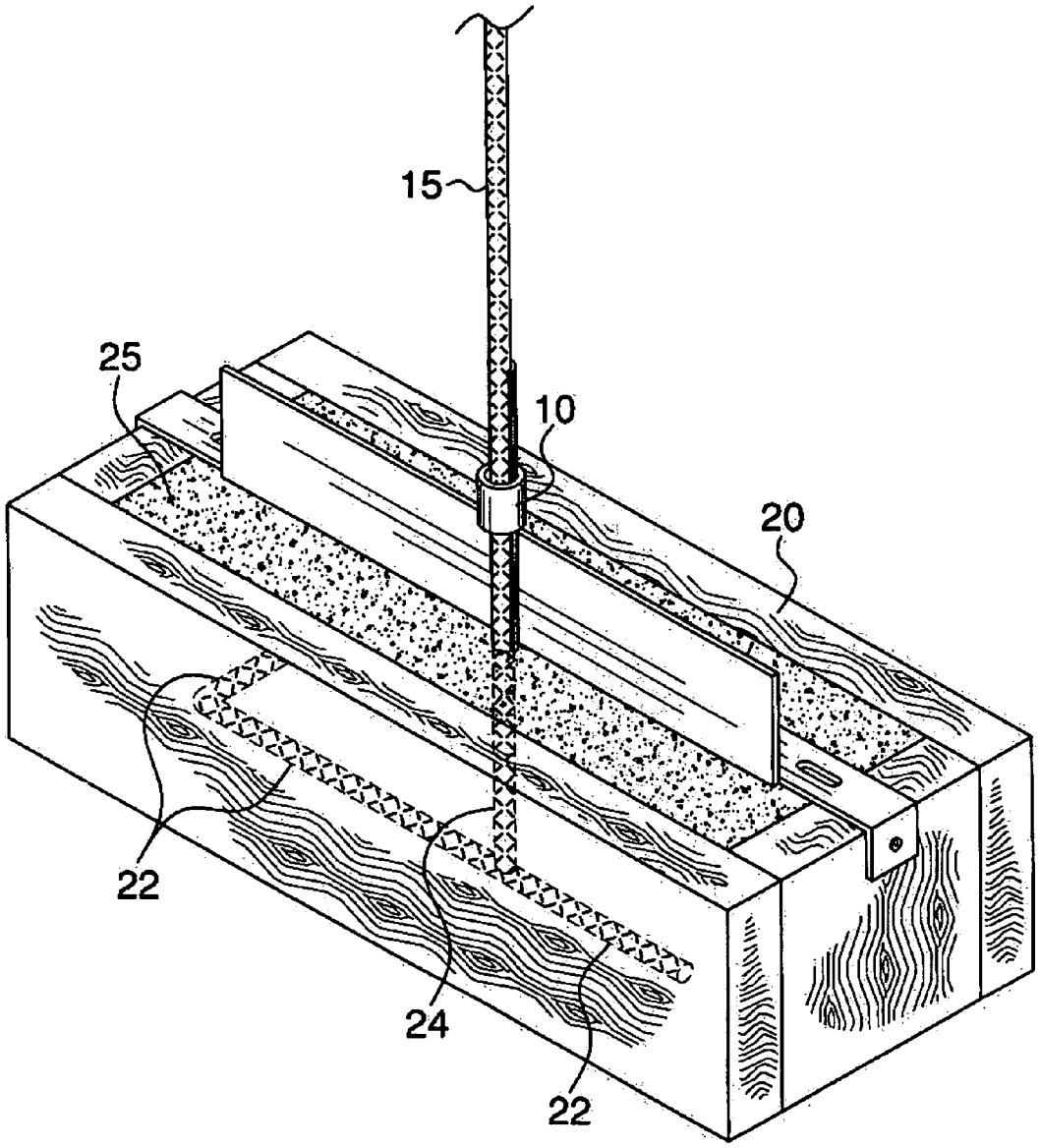
FIG. 5 is an isometric view of the device as it is installed over the footer casing.

The device 5 is comprised of a long, horizontal member 12, which is flat and most likely manufactured from steel. The long horizontal member 12, is placed over the top of the footer casing 20 or mold as shown in FIG. 5. On either end of the long horizontal member 12 are pieces of angles with mounting holes 14 to install and secure it to the footer casing 20.

The footer casing 20 is usually in a wooden box or other similar structure. Prior to installing the footer, a wooden box is manufactured or made in the general shape of the footer; it is into this box or casing that the rebar 22, which forms the foundation for the house is positioned and concrete 25 is poured over the rebar 22 to form the footers. The stub steel or piece of vertical rebar 15 is attached to the housing rebar 22 below the level of the concrete.

The means to secure the device to the sides of the footer casing 20 is accomplished by using a securement means through the mounting holes 14, which are provided on the pieces of angle iron 18. The means to secure the device 5 to the footer casing 20 is probably a screw, a nail or may be other type of securement means.

Positioned at a ninety degree angle to the long horizontal member 12 is a vertical member 13 of predetermined height, length and thickness. The long horizontal member 12 and the vertical member 13 are likely manufactured as one piece but may also be welded together. In the approximate middle of the vertical member 13 will be a support pipe or guide pipe 16, which is semicircular, and attached to one side of the vertical member 13 and extending a predetermined vertical distance above the top edge of the vertical member 13.

The piece of vertical rebar 15 above the ground would fit within the space within the guide pipe 16 and a slide or collar 10, which is round and hollow would be installed over the rebar and over the guide pipe 16 to secure the rebar 15 in position, and wherein the top of the vertical member acts as a stop for the slide pipe.

After the rebar 15 is installed and the device 5 is mounted to the footer casing, concrete 25 is poured into the casing and allowed to set, or cure. The piece of vertical rebar below the top of the concrete has been secured to horizontal pieces of the rebar 22 which form the foundation prior to the pouring of any concrete.

In order to insure that the device 5 does not shift while secured to the footer mold, other pieces of stock 21 are placed in a vertical position relative to the underside of the long flat horizontal member 12. When the device 5 is installed over the top of the footer casing 20 the pieces of angles with the holes 14 would be placed on the outside of the footer mold 20 and the other pieces of stock 21 would abut the interior surface of the footer mold 20. The pieces of stock 21 extend the same distance as the pieces of angle 14 and are parallel to the pieces of angle 14 on the respective ends.

Because this tool will be used in the construction trade, it is likely to be made of a durable, non-corrosive material, and steel is probably an excellent choice of material.

While the embodiments of the invention have been disclosed, certain modifications may be made by those skilled in the art to modify the invention without departing from the spirit of the invention.

The inventor claims:

1. A device to install vertical re-enforced steel or rebar in a building footing, which is comprised of:

a casing;

wherein the casing forms a structure into which concrete for a building footer is poured;

said casing has defined side walls of predetermined thickness;

said casing has a defined bottom;

said casing is open on the top surface;

a horizontal member that is of a predetermined length and thickness;

said horizontal member is placed over the top surface of the casing structure;

wherein pieces of angle iron from the ends of the horizontal member;

said pieces of angle iron are positioned vertically in relation to the horizontal member;

wherein the pieces of angle iron are of a predetermined length;

mounting holes are positioned on the end pieces of angle iron;

wherein interior pieces of stock are placed on the underside of the horizontal member at a predetermined distance from the ends of the angle iron;

said interior pieces of stock are positioned to rest flush against the interior surface of the casing;

vertical member;

wherein a vertical member is secured to the horizontal member;

wherein the vertical member is essentially perpendicular to the horizontal member along one edge of the horizontal member;

a guide pipe;

wherein a guide pipe is attached and secured to the vertical member in the approximate middle of the horizontal member;

wherein the guide pipe is semicircular;

wherein a piece of vertical rebar is inserted in the space formed by the guide pipe;

slide pipe;

wherein the slide pipe is hollow;

wherein the slide pipe slides over the rebar when it is placed in the guide pipe;

wherein the rebar is secured in place to the guide pipe using the slide pipe;

wherein the slide pipe slips over the rebar and the guide pipe to position the rebar in the device, and wherein the top of the vertical member acts as a stop for the slide pipe.

2. The device as described in claim 1 wherein the means to secure the device to the casing is a screw.

3. The device as described in claim 1 wherein the means to secure the device to the casing is a nail.

* * * * *